United States Patent [19]

Ferrari

[11] 3,958,890

[45] May 25, 1976

[54] APPARATUS AND METHOD FOR MOVING ROADWAY LANE DIVIDERS

[76] Inventor: Victor Ferrari, 5486 Ranchito Way, Santa Rosa, Calif. 95401

[22] Filed: Aug. 11, 1975

[21] Appl. No.: 603,522

[52] U.S. Cl. ..... 404/9; 404/72
[51] Int. Cl.[2] ..... E01F 9/00
[58] Field of Search ..... 404/12, 10, 9, 13, 11, 404/72

[56] References Cited

UNITED STATES PATENTS

| | | | |
|---|---|---|---|
| 1,433,487 | 10/1922 | Simpson | 404/9 X |
| 1,816,379 | 7/1931 | King | 404/9 X |
| 2,260,051 | 10/1941 | Pardee | 404/12 |
| 2,287,685 | 6/1942 | Jelinek | 404/12 |
| 2,931,279 | 4/1960 | Wiswell | 404/13 |
| 3,245,327 | 4/1966 | Wasley | 404/12 |

*Primary Examiner*—Nile C. Byers
*Attorney, Agent, or Firm*—Phillips, Moore, Weissenberger Lempio & Strabala

[57] ABSTRACT

A roadway has a plurality of lanes defined thereon with a plurality of dividers disposed on the roadway to separate the lanes into first and second groups. A plurality of cross-beams are mounted above the roadway in transverse relationship therewith with each cross-beam having a trolley movably mounted thereon. The trolley has hoist means thereon for selectively paying-out a cable for attachment to the dividers whereby the dividers can be lifted and moved transversely across the roadway to separate the lanes into third and fourth groups having different numbers of lanes than the above-mentioned first and second groups to accommodate changing traffic patterns.

12 Claims, 6 Drawing Figures

APPARATUS AND METHOD FOR MOVING ROADWAY LANE DIVIDERS

BACKGROUND OF THE INVENTION

This invention relates to an apparatus and method for moving dividers on a roadway to selectively change the groupings thereof. It is conventional practice to employ road dividers or delineators during rush hours to increase the number of lanes on one side of the roadway to accommodate heavier traffic and to thus reduce the number of lanes on the other side of the roadway to accommodate the lighter traffic. For example, the Golden Gate Bridge and its access roadway Doyle Drive employ such dividers to accommodate rush hour traffic flows into and out of San Francisco. Certain such dividers do not always provide a traffic barrier for preventing traffic on one side of the roadway from entering the other side of the roadway and into oncoming traffic. In addition, the dividers are moved manually upon travel of a truck therebetween.

SUMMARY OF THIS INVENTION

An object of this invention is to provide an improved method and apparatus for xpeditiously moving a divider on a roadway to change the number of traffic lanes in a pair of adjacent groups thereof, separated by such divider. The apparatus comprises at least one support means mounted vertically above the roadway and transversely across the lanes thereof and hoist means movably mounted on the support means for travel therealong to selectively attach a cable to the divider. Thus, the divider can be raised and moved transversely to a second position on the roadway whereby the number of lanes in each group may be changed to accommodate various traffic patterns.

BRIEF DESCRIPTION OF THE DRAWINGS

Other objects of this invention will become apparent from the following description and accompanying drawings wherein.

DETAILED DESCRIPTION

Figure 1:
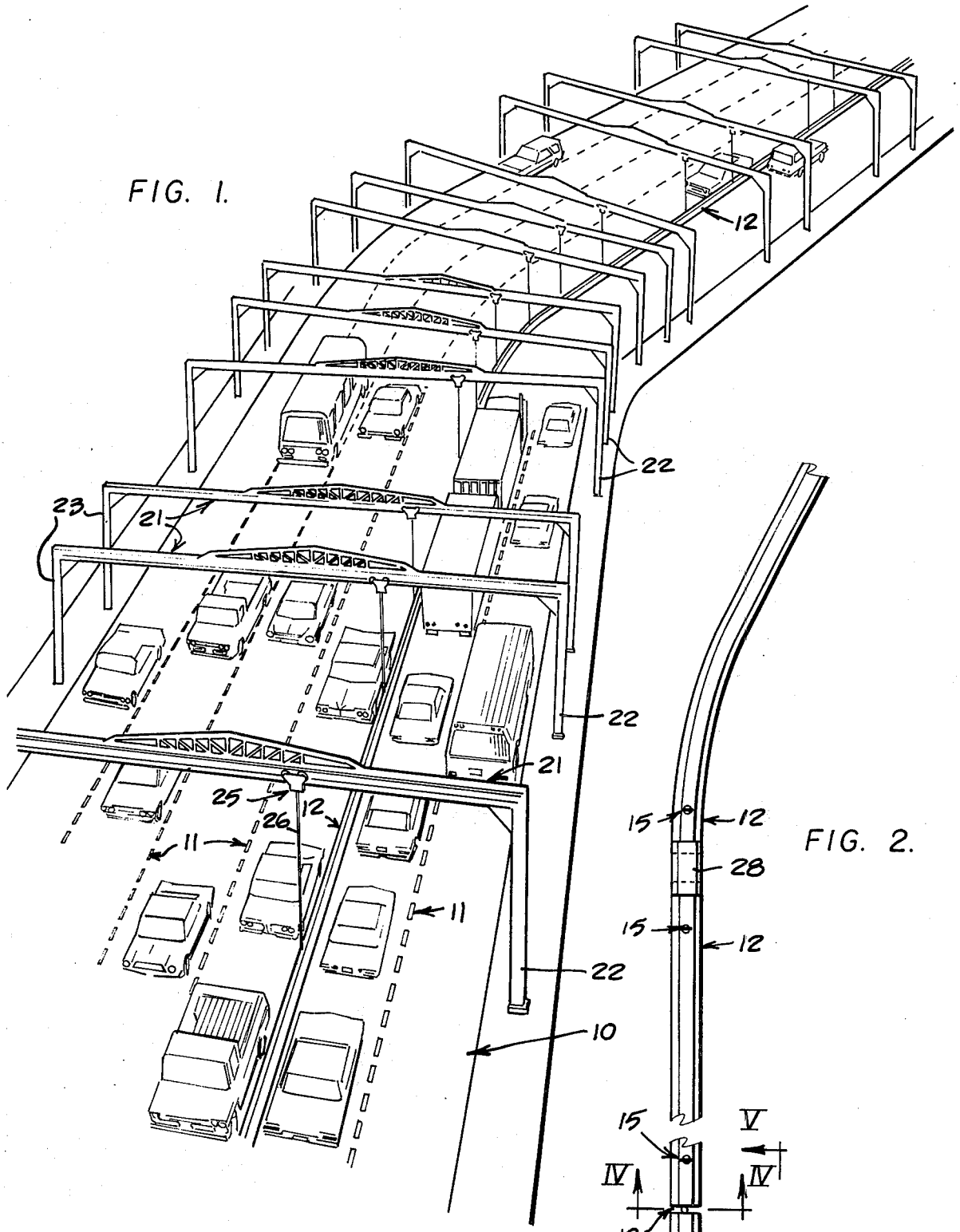
FIG. 1 is a perspective view of a roadway having a plurality of traffic lane delineating apparatus mounted thereabove and adapted to selectively move dividers disposed thereon.
Figure 2:
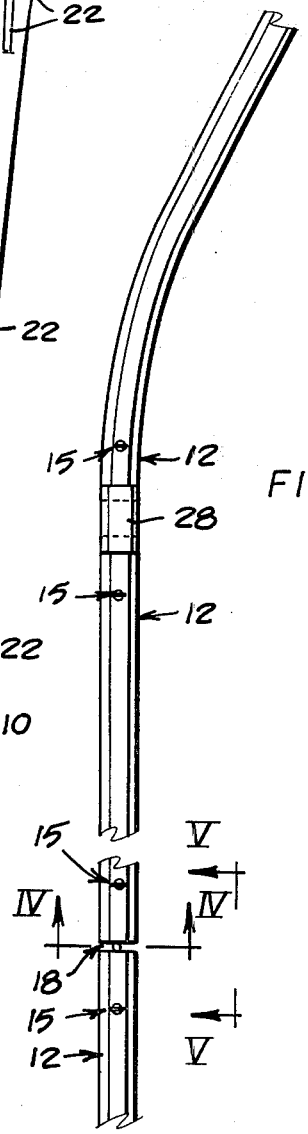
FIG. 2 is a top plan view of a plurality of such dividers connected together at their adjacent ends.

FIG. 1 illustrates a roadway 10 comprising a plurality of lanes defined thereon by indicia 11. A plurality of dividers 12 are disposed on the roadway to divide and separate first and second groups of the lanes to accommodate changing traffic patterns. As more clearly shown in FIGS. 2–5, each divider 12 comprises a base portion 13 and an upstanding wall portion 14.

Figure 5:
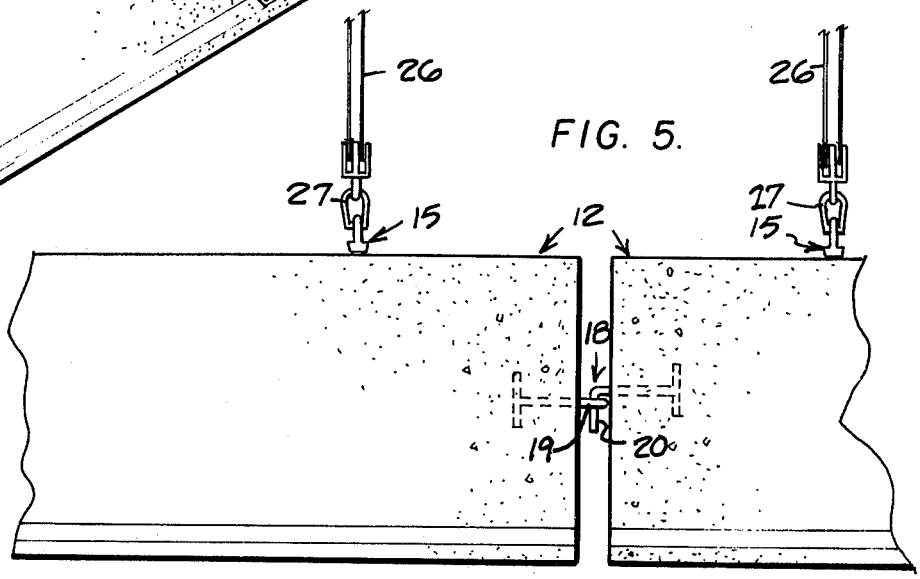
FIG. 5 is a side elevational view of a pair of dividers attached together at adjacent ends thereof by a coupling means.

The divider may be composed of a suitably reinforced concrete material having attachment means 15 secured therein. In the embodiment shown, such attachment means comprises an eyelet 16 secured to the upper end of a rod 17 anchored in the divider. As shown in FIG. 5, opposed ends of a pair of adjacent dividers 12 may be attached together by a coupling means 18 comprising an eyelet 19 anchored in one divider and a hook 20 anchored in the other divider and engaged with the eyelet.

Figure 3:
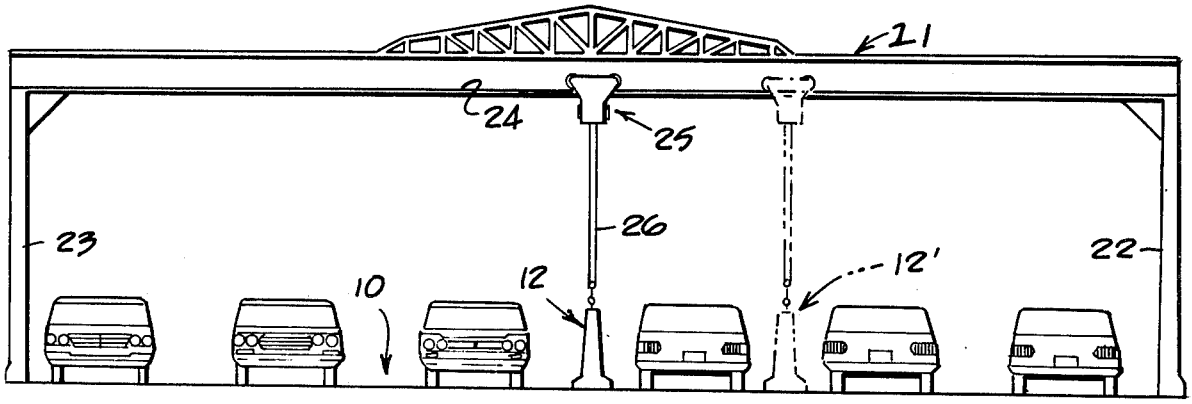
FIG. 3 is an enlarged front elevational view of one of the traffic lane delineating apparatus, further illustrating its capability of repositioning a divider on the roadway.
Figure 4:
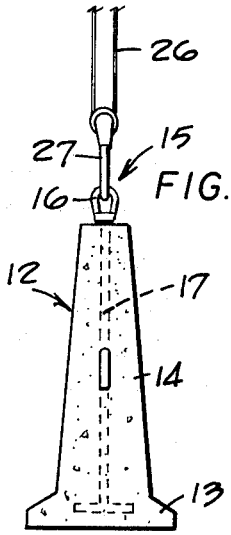
FIG. 4 is an enlarged end elevational view of a divider, taken in the direction of arrows IV–IV in FIG. 2.
Figure 6:
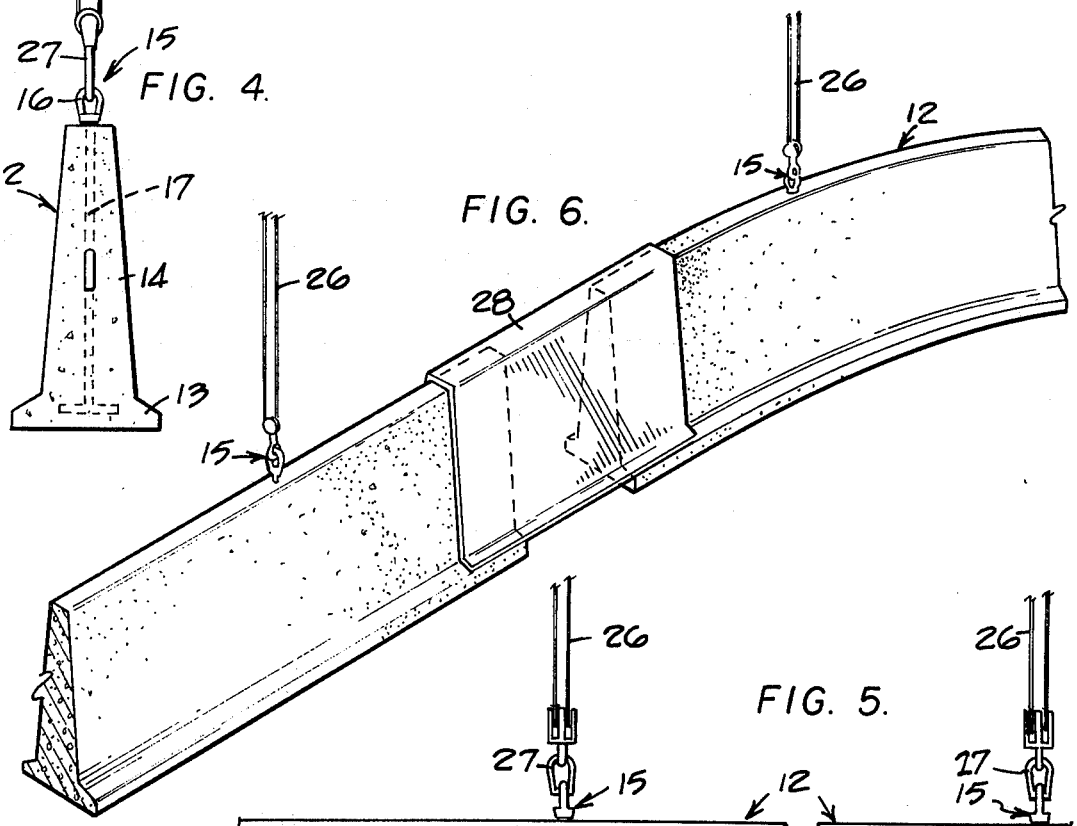
FIG. 6 is a perspective view of a pair of dividers having a cover mounted on adjacent ends thereof.

As shown in FIG. 3, the traffic lane delineating apparatus of this invention comprises a support means or cross-beam 21 mounted vertically above the roadway and transversely across the lanes defined thereon. The support means may be secured on a pair of upright stationary columns 22 and 23 disposed on either side of the roadway. The support means may be in the form of an I-beam having a lower flange 24 thereof function as track means for guiding linear movements of a trolley or hoist means 25 therealong.

The hoist means is adapted to have a cable 26 thereof attached to attachment means 16 to selectively raise and move the divider in conjunction with other hoist means between its full and phantom-line positions illustrated in FIG. 3. Any suitable quick release coupling means 27 may be utilized to attach the cable to attachment means 16. It can thus be seen in FIG. 1 that the dividers are disposed in aligned relationship along the roadway to divide and separate first and second groups of lanes thereof into two lanes and four lanes, respectively. When the dividers are moved from their phantom-line 12' position in FIG. 3 to their full line position therein, the lanes are redivided into third and fourth groups of three lanes each. If so desired, a U-shaped cover 28 may be disposed over the ends of a pair of adjacent dividers whether or not they are attached together by coupling means 18 (FIG. 5).

1. A traffic lane delineating apparatus in combination with a roadway having at least one divider disposed thereon to divide and separate first and second groups of lanes, said divider having a plurality of attachment means secured thereon, said apparatus comprising at least one support means mounted vertically above said roadway and transversely across said lanes and hoist means movably mounted on said support means for travel therealong for selectively attaching a cable thereof to the attachment means of said divider to selectively raise and move said divider transversely of said lanes to divide and separate the same into third and fourth groups.

2. The apparatus of claim 1 wherein a plurality of said dividers are disposed on said roadway with ends of each pair of adjacent dividers being disposed closely adjacent to each other.

3. The apparatus of claim 2 further comprising coupling means releasably attaching the adjacent ends of said pair of dividers to each other.

4. The apparatus of claim 3 wherein said coupling means comprises an eyelet anchored to one of said pair of dividers and a hook anchored to the other one of said dividers and disposed in said eyelet.

5. The apparatus of claim 2 further comprising a cover mounted on the adjacent ends of said pair of dividers to cover the same.

6. The apparatus of claim 1 wherein each of said dividers is composed of a reinforced concrete material and comprises a base portion and an upstanding wall portion.

7. The apparatus of claim 1 wherein a plurality of said support means are disposed in spaced relationship along said roadway, each of said support means comprising a pair of upstanding posts disposed on either side of said roadway and a horizontally disposed cross-beam secured between said posts.

8. The apparatus of claim 7 wherein said hoist means comprises a trolley movably mounted on each of said cross-beams and coupling means attached to a lower end of said cable and releasably attached to a respective one of the attachment means secured to said divider.

9. A method for dividing and separating lanes of a roadway into various grouping comprising the steps of disposing a plurality of dividers in a first position on said roadway into end-to-end relationship to divide and separate said lanes into first and second groups, attaching a cable means to said dividers, raising said dividers vertically by said cable means, moving said dividers transversely relative to said lanes to dispose said dividers in a second position above said roadway, and lowering said dividers onto said roadway into end-to-end relationship to divide and separate said lanes into third and fourth groups.

10. The method of claim 9 wherein said moving step comprises moving a trolley, having said cable means attached thereto, transversely relative to said lanes.

11. The method of claim 9 further comprising the step of releasably attaching adjacent ends of each adjacent pair of said dividers together when said dividers are disposed on said roadway.

12. The method of claim 9 further comprising the step of mounting a protective cover over adjacent ends of each adjacent pair of dividers when said dividers are disposed on said roadway.

* * * * *